United States Patent [19]

Cowgill

[11] 4,353,476

[45] Oct. 12, 1982

[54] PAINT APPLICATOR HOLDER

[76] Inventor: Charles F. Cowgill, 387 Amity Rd., Galloway, Ohio 43119

[21] Appl. No.: 166,584

[22] Filed: Jul. 7, 1980

[51] Int. Cl.[3] ..... B65D 25/20

[52] U.S. Cl. ..... 220/85 D; 220/85 R; 40/306; 248/111; 401/125; 215/100 R; 206/216; 206/362.4; 206/460; 206/813

[58] Field of Search ..... 206/361, 362.4, 813, 206/216, 460; 215/100 R; 220/85 R, 850, 90, 23.2; 248/110–113; 401/123, 125; 40/306, 310, 312

[56] References Cited

U.S. PATENT DOCUMENTS

| | | | |
|---|---|---|---|
| 605,213 | 6/1898 | Weller | 215/100 R |
| 1,226,897 | 5/1917 | Laussedat | 40/310 |
| 1,386,501 | 8/1921 | Hite | 40/310 |
| 1,420,297 | 6/1922 | Thompson | 215/100 R |
| 1,618,724 | 2/1927 | Pearson | 215/100 R |
| 1,850,369 | 3/1932 | Andrews | 40/310 |
| 2,057,828 | 10/1936 | Hartwell | 206/362.4 |
| 2,323,342 | 7/1943 | McManus et al. | 206/813 |
| 2,506,821 | 5/1950 | White | 206/362.4 |

FOREIGN PATENT DOCUMENTS

| | | | |
|---|---|---|---|
| 478680 | 11/1951 | Canada | 206/361 |

*Primary Examiner*—William Price
*Assistant Examiner*—Gary E. Elkins
*Attorney, Agent, or Firm*—Robert B. Watkins

[57] ABSTRACT

A holder for paint brushes and other paint applicators which is attached or attachable to the paint container, and which is constructed of moisture resistant sheet or film-like materials to conform to and adhere to the container. The holder folds outward to form a pocket for the paint brush during the painting process.

5 Claims, 4 Drawing Figures

PAINT APPLICATOR HOLDER

SUMMARY OF THE INVENTION

This invention relates to a leak-proof receptacle for a paint applicator, such as a paint brush, to be mounted or attached to the side of a paint container or can to permit the normal handling of the paint container by a painter with the paint brush being carried in the receptacle attached to the side of the paint container.

The paint applicator receptacle of the invention comprises two walls including an inner attachment wall, and an outer wall which are connected together on three sides or edges, one being the bottom. The receptacle is formed to flexibly fit and be attached to the side of the paint container.

In use, the outer wall is flexibly separated from the attachment wall to form the receptacle—a pocket to hold the paint brush. The receptacle may be a part of the label that is usually fastened on the outside of the paint container.

The prior art includes many other paint supports and receptacles for holding paint brushes either on the outside or inside of a paint can. One of the principle drawbacks of the previous paint brush holders is that the cost of producing the receptacle is high enough to dictate that the item must be sold to customers. In other words, they are too expensive to be given away without charge. This invention fills the current void for a very inexpensive receptacle that may be given away by paint dealers to promote sales. Even if not provided with the sale of paint, they can be sold so cheaply that many customers will buy them as an item to be used once and thrown away at the end of a job.

U.S. Pat. Nos. 3,407,429, 2,748,977, and 2,808,960 are typical examples of prior inventions that are related to the need which is served by this invention. They are cited herein in recognition of the requirements of 37 CFR 1.56 as well as to provide a further understanding of the field of this invention.

In one embodiment of this invention, the paint brush holder is provided as an integral part of the label on a paint can. Because of the construction and materials used in the invention, the additional cost in making the receptacle part of the label is very little. The benefit comes to the user at practically no cost.

In another embodiment the receptacle is constructed separately from the paint container and is adhered to the container as a separate procedure in the preparation for painting.

An object of the invention is to promote safety in painting from ladders by providing a receptacle attached to the container which will hold the brush in a readily accessible position and at the same time keep the brush from collecting extraneous dirt and in a condition ready for use.

Another object of the invention is to provide a receptacle of such simple and inexpensive construction that paint dealers may be able to give a receptacle to each customer purchasing a container thereby providing an incentive for the customer to purchase paint from the dealer who provides receptacles. The dealer may print his name or other advertising material on the receptacle as desired.

In summary the invention is a receptacle for a paint applicator constructed for adherence to the side of a paint container, comprising: an attachment wall having an adhesive composition on one side and edge members attached to the other side; an outer wall attached to the edge members on three sides with an unattached fourth side; and an adhesive composition disposed upon the attachment wall, with the composition being formulated for adherence to the outer surface of the paint container and the attachment wall.

A clearer understanding of the invention will be apparent from the following drawings and detailed description.

DETAILED DESCRIPTION OF THE INVENTION

Figure 1:
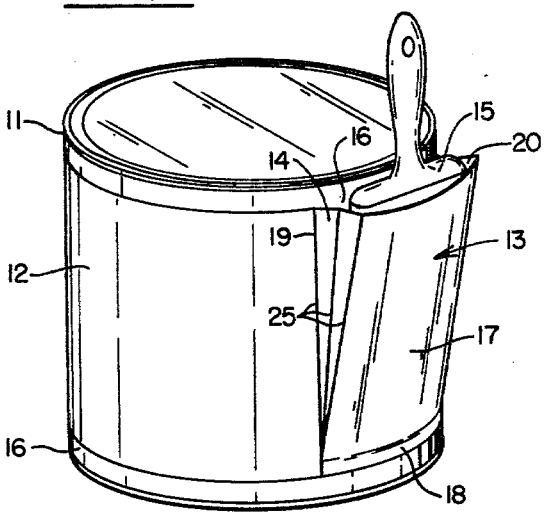
FIG. 1 is a prospective view of a paint container having the paint applicator holder of this invention in place with a paint brush in the holder.

In FIG. 1, a paint container 11, which is shown as a conventional paint can made of metal of well known construction, is wrapped with a label sheet 12 affixed to the outer circular surface 16. The label sheet 12 is made from a leak proof moisture resistant material such as heavy duty or impregnated paper, or even lightweight plastic film. The label sheet 12 may be imprinted with whatever indicia is desired that may provide advertising as well as other nomenclature about the contents.

A receptacle 13 is constructed as a part of the label sheet 12 and includes an outer wall 17 attached to edge members 14 which are formed by bellows-like creases 25. At a bottom lower end 18 the outer wall 17 is adhesively fastened to the surface 16 of the container 11. Edge members 14 are adhesively attached to the container 11 at each side 19. By the above described construction it is seen that the holder 13 is attached at the sides 19 and the bottom 18 and is open at the top 2 forming the receptacle 13 of this invention.

A paint brush or other applicator, such as a paint roller or a sponge, may be placed in the receptacle 13 through the opening 20 at the top which is formed by folding out the edges 14. This is provided by the bellows construction.

On the other hand, until the time that the receptacle is to be used, it is constructed to lie flat against the side of the container with the creases between the edge members folded tightly against the surface of the paint container.

Figure 2:
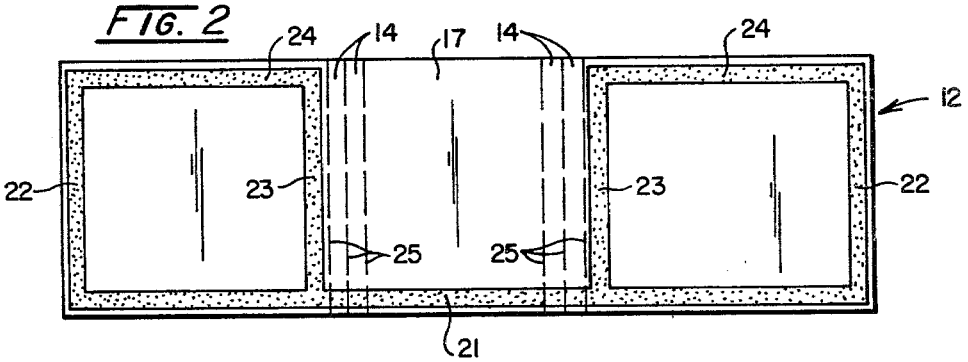
FIG. 2 is a plan view of unassembled material prepared and ready for assembly as a paint applicator holder of this invention.

Referring to FIG. 2, the label sheet 12 is shown in its developed form previous to assembly on the paint container 11. In FIG. 2, the view is from the attachment side showing overlaid strips of adhesive material, 22, 23 and 24, laid upon the label sheet 12 in position to hold the label to the surface of the container 11 in the position shown in FIG. 1. Between the adhesive strips 23 the outer wall portion 17 is positioned with a series of creases 25 that are placed to form the edge members 14 in the final bellows construction of the receptacle 13.

In the final assembly the edge members 14 are folded over each other along the creases 25 and the label sheet 12 is applied to the container 11 as shown in FIG. 1 with the adhesive strips 21, 22, 23 and 24 holding it in place. Adhesive may be applied in other places on the label sheet 12 to assist as necessary in forming a leak-proof integral unit for the purpose intended.

Figure 3:
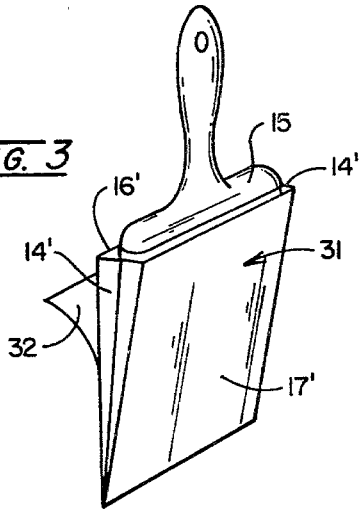
FIG. 3 is a perspective view of another embodiment of a paint brush holder of this invention with a paint brush in the holder.
Figure 4:
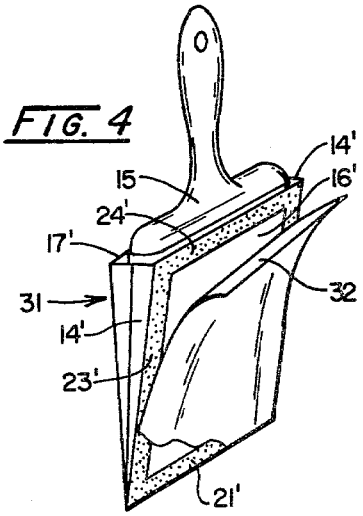
FIG. 4 is perspective view of the embodiment shown in FIG. 3, rotated in perspective to show the opposite side.

Referring to FIGS. 3 and 4, another embodiment of the invention is shown in which a receptacle 31 is constructed with an outer wall 17′ attached to edge members 14′. The edge members 14′ are at the sides of attachment wall surface 16′ which is opposite to the outer wall surface 17′. Strips of adhesive 22′, 23′, and 24′ are spread upon the attachment wall surface 16, and are masked from the air by a cover sheet 23. Cover sheet 23 is made of a waxed paper or other material that does not permanently stick to the adhesives 22′, 23′, and 24′.

Edge members 14′ have creases to form a bellows construction. The bellows construction allows the outer wall 17′ to be separated at the top from the attachment wall surface 16′. The outer wall 14′ is fastened to the attachment wall surface 16′ at the bottom in a leak-proof adhesive seal.

In use the receptacle 31 is readied by peeling the cover sheet 32 from the adhesive strips 22′, 23′, and 24′. The attachment wall surface 16′ is pressed against the side of a paint container. This is normally done when the receptacle 31 is in the closed position, i.e. the bellows is closed and the creases are flattened. After adherence to the paint container, the walls are separated by opening the bellows providing a holder for the paint brush 15 which is inserted in the receptacle 31 as shown.

The selection of suitable materials for the construction of the receptacles 13 and 31 is a matter of choice and well within the ability of those skilled in fields of sheet paper and sheet plastic film product construction. The type of material will depend upon the kind of paint container with which it is used.

In a like manner the selection of an appropriate adhesive is a matter of choice and well within the purview of those skilled in the art. The selection will be among those appropriate for adherence to the paint container and the material of which the holder is constructed and one which is not soluble, therefore will not loosen, in the presence of painting materials. In most instances when the holder 13 is a part of a label sheet 12 and the container 11 is a metal can, the adhesive will be one of those usually used in the application of the label to the paint container in conventional practice.

On the other hand, the adhesive used with the holder 31 of the embodiment shown in FIGS. 3 and 4 is of a different type which is held inactive when covered.

The term paint container as used herein is intended to include containers for all of those coating materials which are conventionally applied with an applicator in the same manner as paint. Included, without limiting, are stains varnishes, and lacquers.

It is herein understood that although the present invention has been specifically disclosed with preferred embodiments and examples, modifications and variations of the concept herein disclosed, may be resorted to by those skilled in the art. Such modifications and variations are considered to be within the scope of the invention and the appended claims.

What is claimed is:

1. A receptacle for a paint applicator, constructed to be adhered to the side of a paint container, comprising:

a. an attachment wall surface formed to meet two sets of edge members, the edge members of each set being formed in a folded bellows construction;

b. an outer wall having a top, sides, and bottom, and being attached to one of said sets of members at each of said sides;

c. an adhesive composition disposed upon the attachment wall surface, and the bottom of the outer wall, the composition being formulated for adherence to the outer surface of the paint container, the attachment wall surface, and the bottom of the outer wall; and d. the receptacle being formed from a sheet which in its developed form before assembly on the paint container comprises, at least one attachment wall portion beside a portion having at least one crease, beside a portion comprising the outer wall, beside another portion having at least one crease, beside an attachment wall portion, the creases being means to form the bellows in the assembled position on the paint container.

2. A receptacle for a paint applicator according to claim 1 wherein the attachment wall surface is a portion of a label on the paint container.

3. A receptacle according to claim 1 wherein the attachment wall surface, the outer wall, and the edge members are made of paper.

4. A receptacle for a paint applicator according to claim 1 wherein the applicator is a brush.

5. A receptacle for a paint applicator according to claim 1 wherein the attachment wall surface is a side of the receptacle opposite to the outer wall.

* * * * *